United States Patent [19]

Unuma

[11] Patent Number: 5,002,413

[45] Date of Patent: Mar. 26, 1991

[54] PAPER FEED TRACTOR

[75] Inventor: Sadao Unuma, Aichi, Japan

[73] Assignee: Tokai Kogyo Kabushiki Kaisha, Aichi, Japan

[21] Appl. No.: 414,523

[22] Filed: Sep. 29, 1989

[30] Foreign Application Priority Data

Nov. 28, 1988 [JP] Japan ..... 63-298197

[51] Int. Cl.[5] ..... B41J 11/30

[52] U.S. Cl. ..... 400/616.2; 400/616.1

[58] Field of Search ..... 400/616, 616.1, 616.2, 400/616.3, 634, 635, 636, 617, 629, 578, 611; 226/170, 171, 174, 74, 75, 86, 6

[56] References Cited

U.S. PATENT DOCUMENTS

| | | | |
|---|---|---|---|
| 4,130,230 | 12/1978 | Seitz | 226/75 |
| 4,358,039 | 11/1982 | Buzzell | 400/616.3 X |
| 4,527,174 | 7/1985 | Fujiwara et al. | 400/617 X |
| 4,707,158 | 11/1987 | Hofmann | 226/74 X |
| 4,715,737 | 12/1987 | Hori | 400/634 X |
| 4,780,013 | 10/1988 | Sakai | 400/616.2 |
| 4,826,337 | 5/1989 | Unuma | 400/616.2 |

FOREIGN PATENT DOCUMENTS

| | | | |
|---|---|---|---|
| 922166 | 3/1963 | United Kingdom | 226/170 |

*Primary Examiner*—Edgar S. Burr
*Assistant Examiner*—Motilal P. Patel
*Attorney, Agent, or Firm*—Berman, Aisenberg & Platt

[57] ABSTRACT

A paper feed tractor comprising a main frame, a sub frame secured to the main frame with a major portion thereof and disposed in parallel to the main frame, and a belt driving unit supported for sliding movement between the main and sub frames. The main and sub frames have first openings formed in a coaxial relationship at locations adjacent one end portions thereof so as to loosely fit a drive shaft therein and second openings formed in a coaxial relationship at locations adjacent the other end portions thereof so as to support a support shaft for sliding movement and for fixation therein. The belt driving unit includes a belt driving sprocket wheel supported for rotation on a plate-formed belt receiving member, and an endless belt extends between the sprocket wheel and a belt guide formed on the belt receiving member. The belt receiving member of the belt driving unit has third and fourth openings formed at locations thereof opposing to the first and second openings for receiving the drive and support shafts loosely therein, respectively. A shaft hole which is formed in the belt driving sprocket wheel for engaging with the drive shaft is exposed to the third opening.

4 Claims, 10 Drawing Sheets

PAPER FEED TRACTOR

BACKGROUND OF THE INVENTION

1. Field of the Invention

This invention relates to a paper feed tractor for supplying paper to a printer for use with a computer, a word processor, a plotter and so forth or to a printer of various other types.

2. Description of the Prior Art

Paper having a pair of feed holes or perforations formed therein along the opposite longitudinal edges thereof is used very frequently on a printer for use with a computer, a word processor, a plotter or the like as paper on which characters or figures outputted from the printer are to be recorded. Such feed holes are formed at fixed intervals on straight lines along the opposite longitudinal edges of the paper at locations spaced by a predetermined distance from the opposite longitudinal edges of the paper and are adapted to be engaged with feed pins which are provided projectingly on a belt of a paper feed tractor at locations corresponding to the opposite longitudinal edges of the paper.

FIGS. 24 to 26 show a conventional paper feed tractor. Referring to FIGS. 24 to 26, the paper feed tractor generally denoted at 1000 includes a main frame 1100 and a sub frame 1200 both made of a plastic material or the like and disposed in a spaced relationship by a predetermined distance from each other. The two frames 1100 and 1200 are integrated with each other by means of a fastening screw 1250 or the like.

An endless belt 1300 made of a rubber or plastic material is supported between the main frame 1100 and the sub frame 1200 for driving movement by a sprocket wheel (not shown) and has a large number of feed pins 1350 provided projectingly on an outer periphery thereof at intervals equal to the intervals of feed holes of paper. A pair of circular through holes $H_1$ and $H_2$ are formed in each of the main frame 1100 and the sub frame 1200, and a hub portion 1800 formed on the sprocket wheel is supported for rotation in the through holes $H_1$ of the main frame 1100 and the sub frame 1200 through which a drive shaft extends. The hub portion 1800 of the sprocket wheel functions as a rotary shaft of the sprocket wheel and has a square through hole formed at a location around a center axis of rotation thereof. The sprocket wheel has teeth formed on an outer periphery thereof for engagement with teeth formed on an inner periphery of the belt 1300 to drive the belt 1300.

The main frame 1100 has a pair of supporting portions 1150 formed thereon for receiving and supporting thereon a shaft 1450 of a cover 1400 which has a paper holder 1460 thereon. A spring 1600 extends between the main frame 1100 and the cover 1400 and normally urges the cover 1400 in its closing direction.

The holes $H_2$ of the main frame 1100 and the sub frame 1200 are adapted to receive a support shaft therein and have a fixing device 1700 provided thereon. The fixing device 1700 includes a collet which clamps the support shaft as a ring 1750 is turned by a certain angle in a direction in order to secure the paper feed tractor 1000 at an arbitrary position on the support shaft.

FIG. 27 shows such paper feed tractors 1000 as described above installed in a printer. In particular, a pair of such paper feed tractors 1000 are mounted at left and right positions on a pair of drive shaft $S_1$ and a support shaft $S_2$ which are disposed in such a manner as to provide an interaxial distance L therebetween in the printer. The drive shaft $S_1$ is supported for rotation on a frame of the printer by means of a pair of left and right bearings $B_1$ while the support shaft $S_2$ are secured to a pair of left and right shaft receivers $B_2$ provided on the printer frame.

The drive shaft $S_1$ is provided to transmit a turning force and has a square cross section to allow the drive shaft $S_1$ to engage with the square through holes of the sprocket wheels of the paper feed tractors 1000. Meanwhile, the support shaft $S_2$ is adapted to slidably engage with the holes $H_2$ formed in the frames 1100 and 1200 of the paper feed tractors 1000 and has a circular cross section.

The left and right paper feed tractors 1000 are each positioned in the drive and support shafts $S_1$ and $S_2$ as shown in FIGS. 27 and 28 while the portions thereof are adjustable in the direction indicated by an arrow mark X parallel to the direction of the axes of the drive shaft $S_1$ and the support shaft $S_2$ in accordance with the width and the position of paper to be fed by the paper feed tractors 1000. The span between the two bearings $B_1$ and the span between the two shaft receivers $B_2$ on which the two shafts $S_1$ and $S_2$ are supported, respectively, is great where the printer is of a large size. As the size of a line printer or the like increases recently, the amount of deflection of a drive shaft such as the drive shaft $S_1$ is apt to increase.

FIG. 28 shows the drive shaft $S_1$ the center axis $CS_1$ or rotation of which is deflected by a maximum amount $d_0$ from a straight line $C_0$ interconnecting the two bearings $B_1$. In the condition, if the drive shaft $S_1$ is driven to rotate in the direction indicated by an arrow mark R around the center axis of rotation thereof, it will rotate with a deflection amount d at a location of each of the paper feed tractors 1000. Consequently, the interaxial distance L between the center axis $CS_1$ of the drive shaft $S_1$ and the center axis $CS_2$ of the support shaft $S_2$ varies during rotation of the drive shaft $S_1$.

Since the interaxial distance L is fixed in the conventional paper feed tractors shown in FIGS. 24 to 26, the deflection amount d is absorbed by clearances between the shafts and receiving members for the shafts. If the deflection amount d increases greater than the clearances, then turning torque required for rotation increases suddenly, which may cause damage to a motor or deterioration in accuracy in feeding paper and make a cause of a trouble of the paper feed tractors.

An apparatus including improved paper feed tractors of the type mentioned is disclosed in U.S. Pat. No. 4,129,239. In the apparatus, a fixing device for securing each of the paper feed tractors to a support shaft is formed as a separate unit from the paper feed tractor such that, when the interaxial distance between a drive shaft and the support shaft is varied by a deflection of the drive shaft, the fixing device unit to be secured to the support shaft may be moved relative to the paper feed tractor coupled for integral movement to the drive shaft to absorb a displacement of the drive shaft by such deformation. However, since the support shaft for the paper feed tractors is held in a stationary condition while the drive shaft is rotated in a deflected condition, the mass of elements driven to rotate in an eccentric relationship by the drive shaft which is rotated in an eccentric relationship corresponds substantially to a mass of the entire paper feed tractors. Accordingly, significant vibrations are produced by the inertia of the mass, which disadvantageously causes resonance of the entire printer to impair the printing performance of the printer and impair the performance of the paper feed tractors.

SUMMARY OF THE INVENTION

It is an object of the present invention to provide a paper feed tractor which absorbs eccentric motion of a drive shaft by a deflection or the like to prevent production of undesirable vibration in an entire apparatus.

Generally speaking, the present invention provides a paper feed tractor which has such a construction that a main frame and a sub frame can be assembled to and engaged with each other and a belt driving unit having a paper feeding belt supported for driving movement thereon is installed between the frames for sliding movement relative to the assembly of the frames.

The main frame and the sub frame have openings formed therein in which a drive shaft and a support shaft are extended respectively. The openings through which the drive shaft extends are formed with sufficiently greater dimensions than the diameter of rotation of the drive shaft while the openings through which the support shaft extends are engaged for sliding movement with the support shaft, and a device for securing the paper feed tractor to the support shaft is provided on the main frame. The belt driving unit has a basic construction that it is composed of the paper feeding endless belt, a belt receiving member for supporting the belt for sliding movement at a peripheral portion thereof, and a belt driving sprocket wheel supported for rotation on the belt receiving member.

With the paper feed tractor according to the present invention, since the assembly composed of the main frame and the sub frame of the paper feed tractor and the belt driving unit on which the paper feeding belt is provided are formed as separate members and engaged for sliding movement with each other, when the main frame and the sub frame are secured to the support shaft and the sprocket wheel of the belt driving unit is driven by the drive shaft, even if the drive shaft is rotated in an eccentric relationship, the belt driving unit will be slidably moved between the main frame and the sub frame assembled in an integral relationship to the main frame, thereby absorbing eccentric motion of the drive shaft caused by deflection or the like. Since the mass of the belt driving unit is significantly small compared with the mass of the entire paper feed device, production of undesirable vibrations in the entire device can be prevented.

The belt receiving member of the belt driving unit is composed of a pair of members having the same configuration engaged in an opposing relationship with each other, the production cost of parts can be reduced, and a plastic material having a characteristic that the belt is liable to slip thereon can be adopted. The endless belt extending around the belt driving unit is meshed at an inner peripheral face thereof with the sprocket wheel supported for rotation in the belt driving unit while an outer peripheral face thereof is restricted by a rib of the belt receiving member of the belt driving unit so that the endless belt is driven without being disengaged from the outer peripheral face of the belt driving unit. The various parts of the paper feed tractor can be made of a plastic material, and where suitable engaging portions are provided, the parts can be assembled without using a fastening member such as a fastening screw.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENT

The drawings show a preferred embodiment of the paper feeding device (tractor) located at a position corresponding to one of the side edges of a paper formed with a pair of rows of feed apertures at both side edges thereof.

Figure 1:
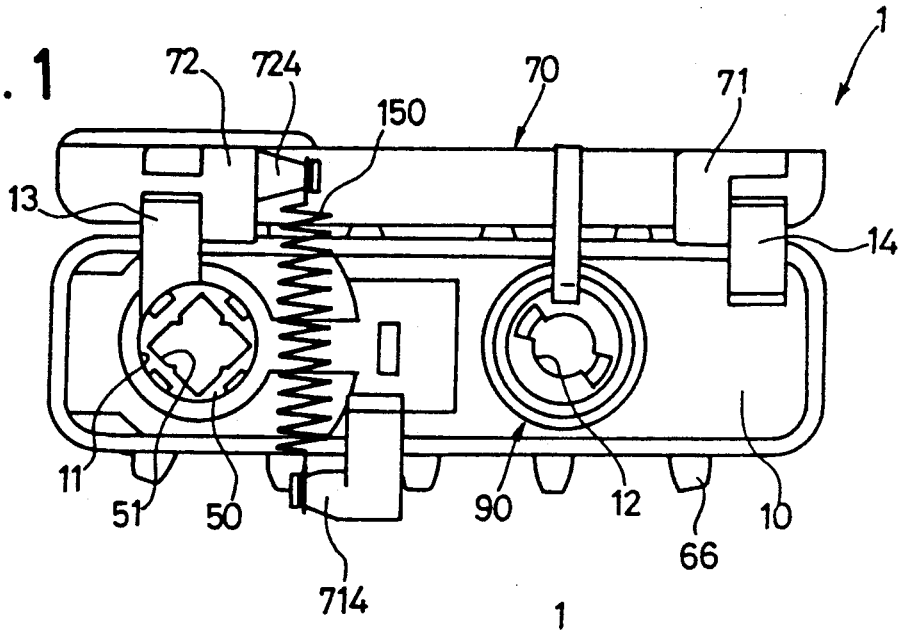
FIG. 1 is a front elevational view of a paper feed tractor according to the present invention.
Figure 2:
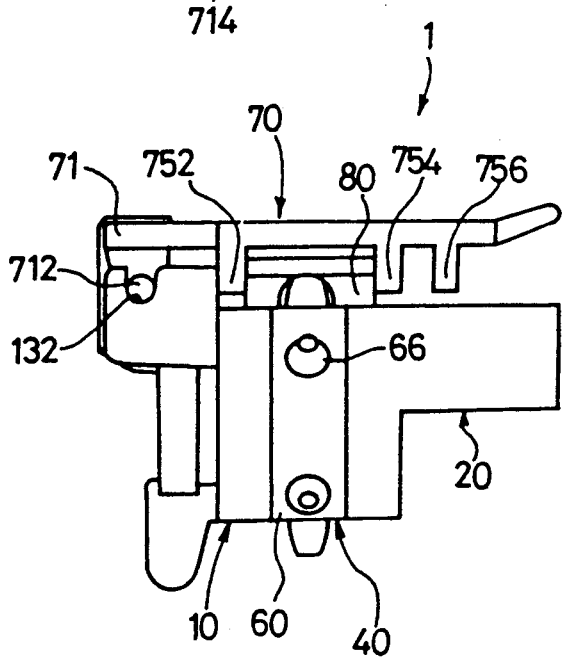
FIG. 2 is a right-hand side elevational view of the paper feed tractor of FIG. 1.
Figure 3:
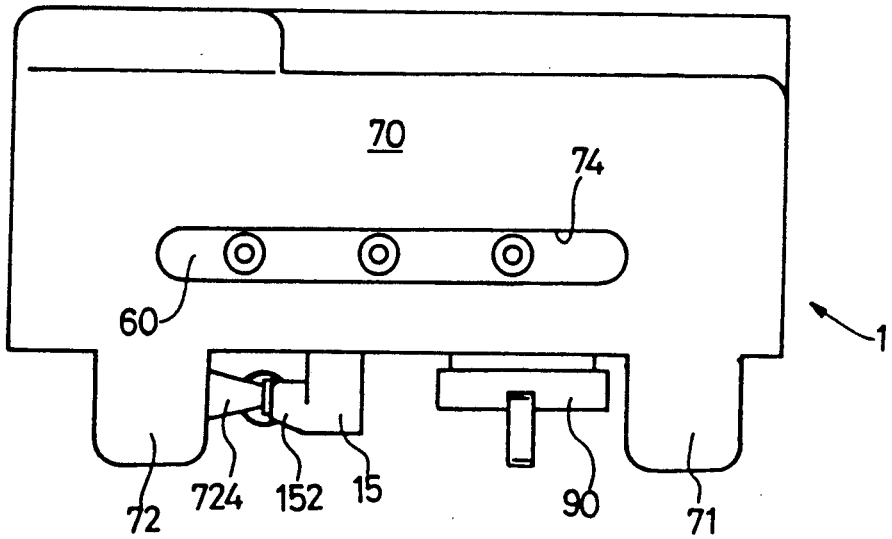
FIG. 3 is a top plan view of the paper feed tractor of FIG. 1.

FIGS. 1 to 3 are front and right-hand side elevational views and a top plan view, respectively, showing an appearance of a paper feed tractor according to the present invention. Referring to FIGS. 1 to 3, the paper feed tractor generally denoted at 1 is composed principally of a main frame 10, a sub frame 20, a belt driving unit 40 disposed between the main frame 10 and the sub frame 20 and supporting a paper feeding endless belt 60 for driving movement thereon, a cover 70 supported for pivotal motion on the main frame 10 by means of a hinge between a position in which it extends in parallel to an upper face of the belt 60 and another position in which it opens the upper face of the belt 60, and a spring 150 extending between the main frame 10 and the cover 70 and normally urging the cover 70 to the position in which it extends in parallel to the upper face of the belt 60.

The main frame 10 has an opening 11 and another opening 12 formed therein so that a drive shaft $S_1$ and a support shaft $S_2$ may extend through the openings 11 and 12 of the main frame 10, respectively, and the belt driving unit 40 disposed in a spacing between the main frame 10 and the sub frame 20 is supported for sliding movement on the main frame 10 and the sub frame 20 along a line interconnecting the center of the opening 11 for the drive shaft $S_1$ and the center of the other opening 12 for the support shaft $S_2$.

A sprocket wheel 50 is supported for rotation on the belt driving unit 40 as hereinafter described. The sprocket wheel 50 has a square hole 51 formed at a location around a center axis of rotation thereof, and the drive shaft $S_1$ having a similar square cross section is fitted in the square hole 51.

Figure 4:
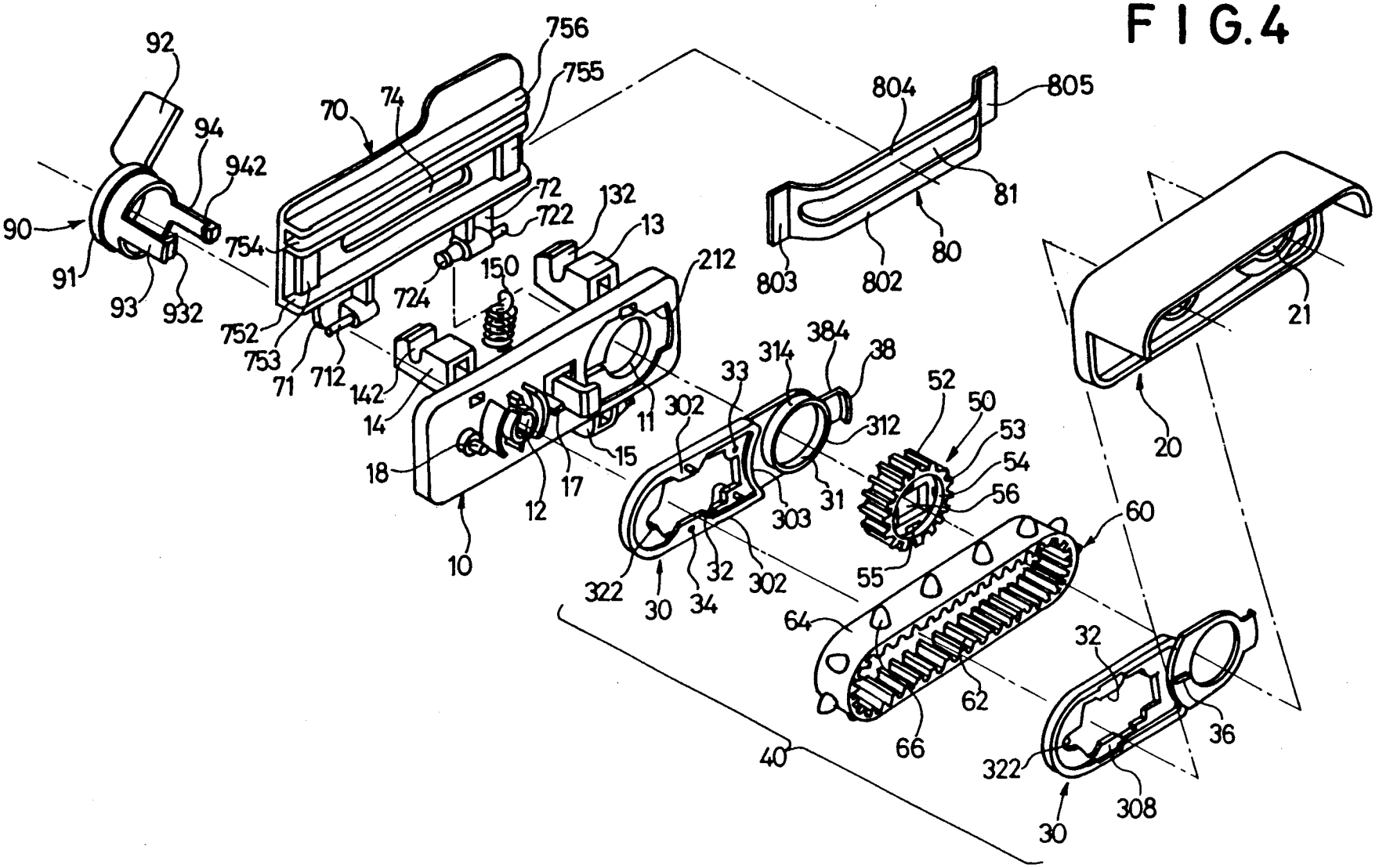
FIG. 4 is a fragmentary perspective view of the paper feed tractor of FIG. 1.

FIG. 4 is a fragmentary perspective view of the paper feed tractor described above. Referring to FIG. 4, the belt driving unit 40 which includes a pair of belt receiving members 30, the sprocket wheel 50 and the endless belt 60 is disposed between the main frame 10 and the sub frame 20. A fixing device 90 for securing the paper feed tractor 1 to the support shaft $S_2$ is mounted on the main frame 10 in such a manner as hereinafter described, and the cover 70 is supported for pivotal opening and closing movement at an upper location of the main frame 10 by means of a pair of support shafts 712 and 722. The cover 70 is normally urged in the direction so its closing position by the spring 150 which extends between a support shaft 724 located in an eccentric relationship from the support shafts 712 and 722 and a spring receiver 15 provided on the main frame 10. A paper holder 80 in the form of a plate having a spring action is mounted on a lower face of the cover 70 and has a slit 81 formed in a longitudinal direction at a central portion thereof such that, when the cover 70 is closed, feed pins 66 provided projectingly on the belt 60 can pass in the slit 81 and side edge portions of the slit 81 are pressed against a surface of a belt body 64 of the belt 60 under the resilient force of the spring 150. Also the cover 70 has a slit 74 formed therein corresponding to the slit 81 of the paper holder 80 so that a running condition of the belt 60 can be observed from above the cover 70. Those parts can all be made of a synthetic resin material except the spring 150.

In the following, the individual parts will be described in detail.

Figure 5:
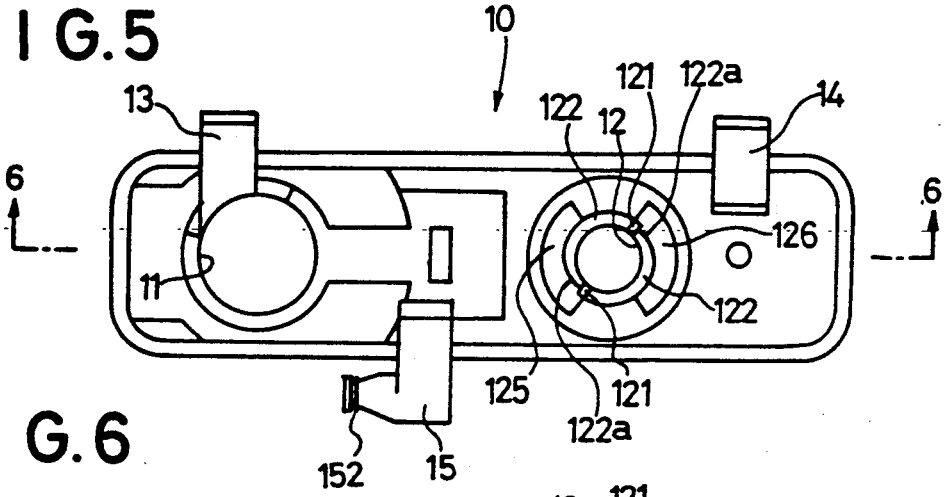
FIG. 5 is a front elevational view of a main frame of the paper feed tractor of FIG. 1.
Figure 6:
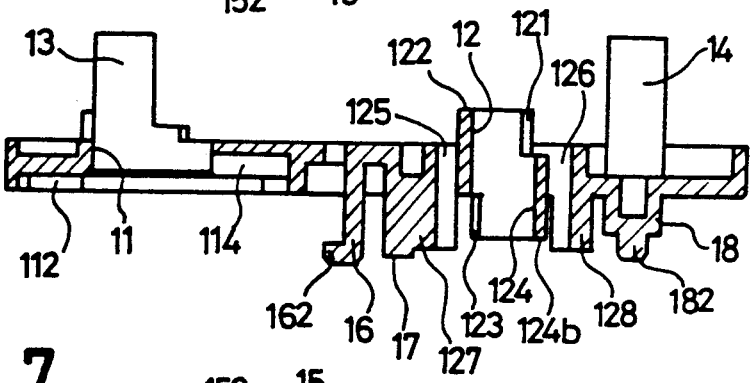
FIG. 6 is a sectional view taken along line 6—6 of FIG. 5.

FIGS. 5 to 8 show details of the main frame 10, and FIG. 6 is a sectional view taken along line 6—6 of FIG. 5. The main frame 10 made of a synthetic resin material has the openings 11 and 12 formed therein such that the drive shaft $S_1$ and the support shaft $S_2$ may extend therethrough, respectively. While the diameter of the opening 11 has a sufficiently great dimension comparing with an orthogonal line of a square cross section of the drive shaft $S_1$ while the diameter of the other opening 12 is formed with a little greater dimension than the diameter of the support shaft $S_2$.

A pair of semi-cylindrical lip portions 122 are formed on the main frame 10 around the opening 12 in a spaced relationship from each other by a pair of slits 121 and extend outwardly in an integral relationship from a side wall of the main frame 10. The outer diameter of outer peripheral portions 122*a* of the lip portions 122 on the side adjacent the slits 121 is a little smaller than the other portions of the lip portions 122, and a pair of arcuate through holes 125 and 126 are formed in the main frame 10 on the diametrically outer sides of the lip portions 122. Thus, if legs 93 and 94 of the fixing device 90 which will be hereinafter described are fitted into the through holes 125 and 126 of the main frame 10 making use of the holes 125 and 126 and the smaller diameter outer peripheral portions 122*a* of the lip portions 122 and the fixing device 90 is turned, then projections formed on an inner periphery of the fixing device 90 will press against the lip portions 122 except the smaller diameter outer peripheral portions 122*a* to resiliently deflect the lip portions 122 inwardly to grasp the support shaft $S_2$ therein. Consequently, the paper feed tractor can be secured to the support shaft $S_2$.

A pair of bearings 13 and 14 extend from upper portions of the main frame 10 and have grooves 132 and 142 formed therein, respectively. The support shafts 712 and 722 of the cover 70 are engaged for rotation in the grooves 132 and 142 of the bearings 13 and 14, respectively. The spring receiver 15 extends from a lower portion of the main frame 10, and the spring 150 is anchored at an end portion thereof to a neck portion 152 of the spring receiver 15.

Figure 7:
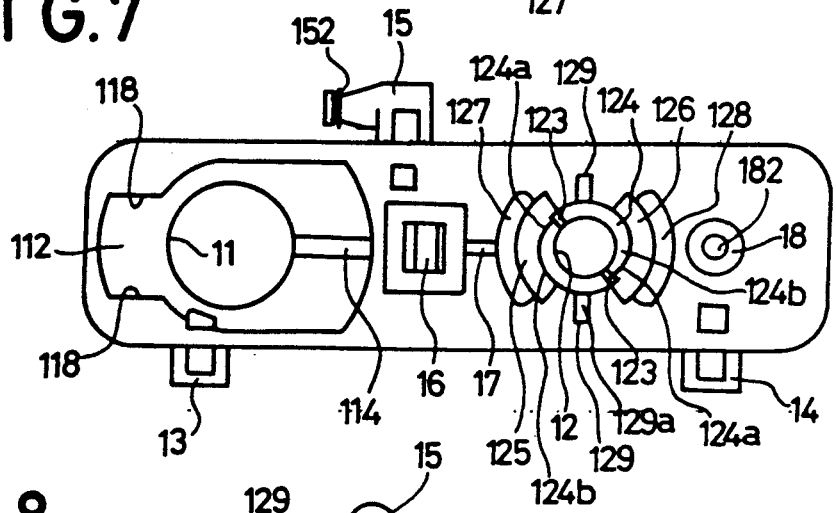
FIG. 7 is a rear elevational view of a main frame of FIG. 5.
Figure 8:
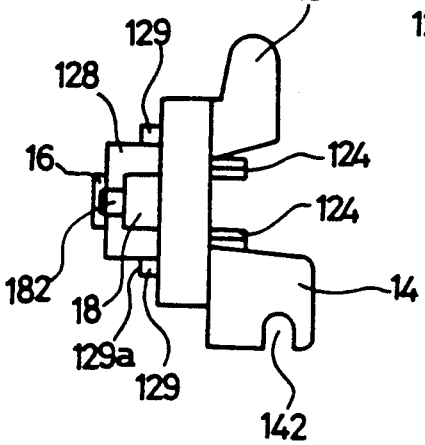
FIG. 8 is a right-hand side elevational view of the main frame of FIG. 5.

FIG. 7 shows and inner side face of the main frame 10. The main frame 10 has a recess 112 formed therein around the opening 11 and recessed in the direction of thickness thereof. A groove 114 is formed deeply in the direction of the thickness of the main frame 10 in the bottom of the recess 112 and extends along a line interconnecting the center of the opening 11 and the center of the other opening 12. The groove 114 is adapted to be slidably engaged by a projection of one of the belt receiving members 30 which will be hereinafter described. An arm 16 for coupling the main frame 10 to the sub frame 20 is provided substantially perpendicularly on the side face of the main frame 10 substantially at a central location of the line interconnecting the centers of the openings 11 and 12. A bent portion 162 is formed at an end of the arm 16.

A pair of arcuate hub portions 127 and 128 are formed projectingly on the inner side face of the main frame 10 in a contiguous relationship to outer circumferential edges of the arcuate through holes 125 and 126 formed at diametrically outer positions of the opening 12 along the line interconnecting the centers of the openings 11 and 12, and a rib 17 is provided projectingly on the inner side face of the main frame 10 between the hub portion 127 adjacent the opening 12 and the arm 16 along the line interconnecting the centers of the openings 11 and 12. An end of the rib 17 extends from an end of the hub 127 so that it may be held between projections of the sub frame as hereinafter described.

A pair of semi-cylindrical lip portions 124 are formed on the main frame 10 around the opening 12 in a spaced relationship from each other by a pair of slits 123 and extend inwardly in an integral relationship from the inner side wall of the main frame 10. The outer diameter of outer peripheral portions 124*a* of the lip portions 124 on the side adjacent the slits 123 is a little smaller than the other portions of the lip portions 124. The outer peripheral portions 124*a* of the lip portions 124 are formed in a contiguous relationship to the smaller diameter outer peripheral portions 122*a* formed on the lip portions 122 provided on the outer side face of the main frame 10 so as to allow fitting of the legs 93 and 94 of the fixing device 90. A pair of ribs 129 are formed projectingly on the inner side face of the main frame 10 at diametrically outer positions of the lip portions 124 in a separate relationship from the portions 124 and extend perpendicularly to the line interconnecting the openings 11 and 12. End faces 129*a* of the ribs 129 are supported for sliding movement on one of the belt receiving members 30.

A hub portion 18 having a step thereon is provided projectingly on the inner side face of the main frame 10 at a location on the outer side of the opening 11 with respect to the opening 12 on the line interconnecting the centers of the openings 11 and 12, and a projection 182 of a smaller diameter is formed at an end portion of the hub portion 18.

Figure 9:
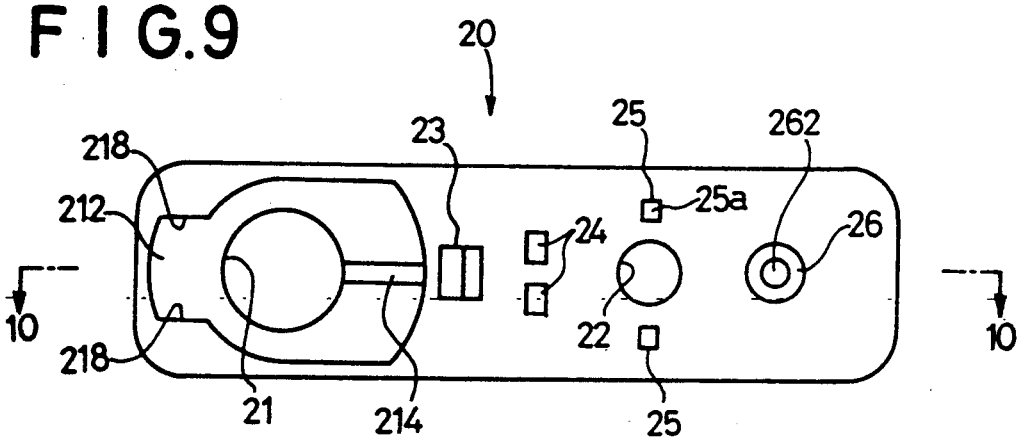
FIG. 9 is a rear elevational view of a sub frame of the paper feed tractor of FIG. 1.
Figure 10:
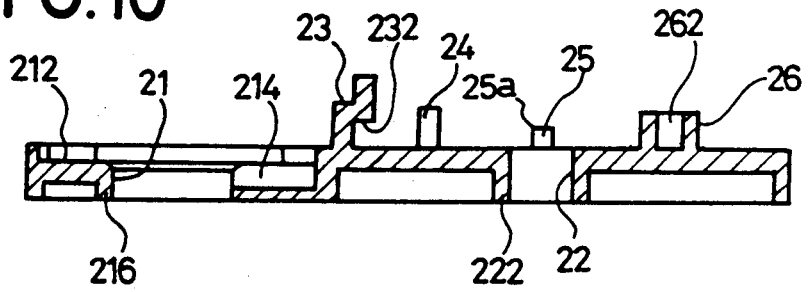
FIG. 10 is a sectional view taken along line 10—10 of FIG. 9.

FIGS. 9 to 12 show details of the sub frame 20, and FIG. 9 shows an inner side of the sub frame 20 while FIG. 10 is a sectional view taken along line 10—10 of FIG. 9. Also the sub frame 20 has a circular opening 21 and another circular opening 22 formed therein such that the drive shaft and the support shaft may extend therethrough, respectively. A recess 212 is formed in the sub frame 20 around the opening 21 and recessed in the direction of the thickness of the sub frame 20. A groove 214 is formed in the bottom of the recess 212 and recessed in the direction of the thickness of the sub frame 20. The groove 214 extends along a line interconnecting the centers of the openings 21 and 22. An arm 23 corresponding to the arm 16 of the main frame 10 is provided projectingly on the inner side face of the sub frame 20 along the interconnecting line such that the bent portion 162 of the arm 16 of the main frame 10 may be engaged with a bent portion 232 of the arm 23 to fasten the main frame 10 and the sub frame 20 in an integral relationship to each other. A pair of rib receivers 24 are provided projectingly across the interconnecting line such that, when the main frame 10 and the sub frame 20 are assembled to each other, the rib 17 of the main frame 10 described hereinabove may be held between the rib receivers 24.

A pair of projections 25 are formed on the inner side face of the sub frame 20 at locations on a line perpendicular to the line interconnecting the centers of the openings 21 and 22 on the opposite sides of the opening 22 through which the support shaft extends. The projections 25 are adapted to support, at outer peripheral faces 25*a* thereof, one of the belt receiving members 30 for sliding motion thereon. A hub 26 is provided projectingly at a location on the interconnecting line on the outer side farther than the opening 21 with respect to the opening 22, and the projection 182 at the end portion of the hub portion 18 of the main frame 10 described hereinabove is fitted in a center hole 262 of the hub 26.

Figure 11:
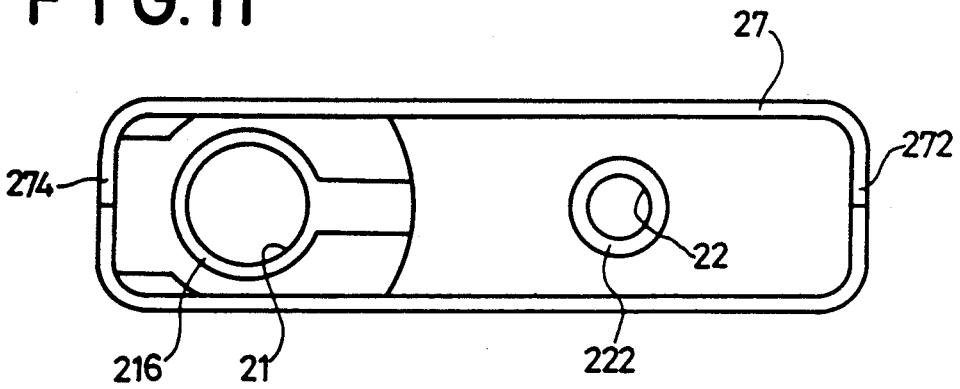
FIG. 11 is a front elevational view of the sub frame of FIG. 9.
Figure 12:
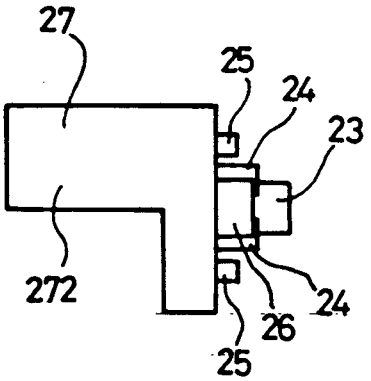
FIG. 12 is a right-hand side elevational view of the sub frame of FIG. 9.

A hub portion 216 and another annular hub portion 222 are provided projectingly on an outer side face of the sub frame 20 shown in FIG. 11. The hub portion 216 is formed so as to surround the opening 21 through which the drive shaft extends while the annular hub portion 222 is formed so as to surround the opening 22 through which the support shaft extends. A paper receiving table 27 is formed in an integral relationship at an upper half of the sub frame 20 and extends in a direction perpendicular to the frame 20. The paper receiving table 27 extends along an upper edge portion of the sub frame 20 and depends at front and rear ends 272 and 274 thereof to the line interconnecting the centers of the openings 21 and 22.

Figure 13:
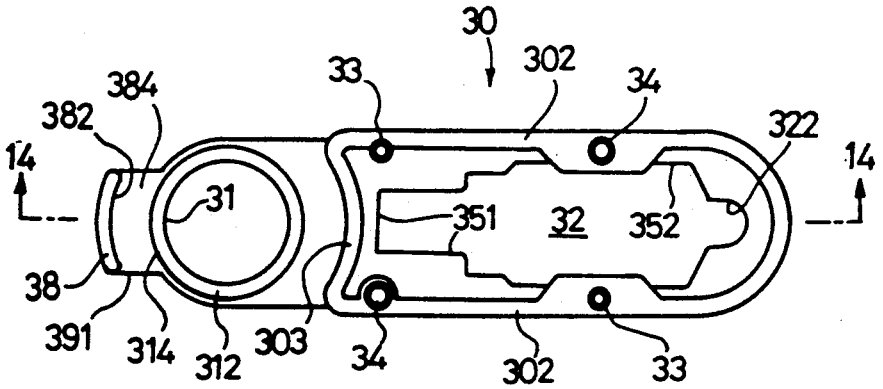
FIG. 13 is a rear elevational view of a belt receiving member of the paper feed tractor of FIG. 1.
Figure 14:
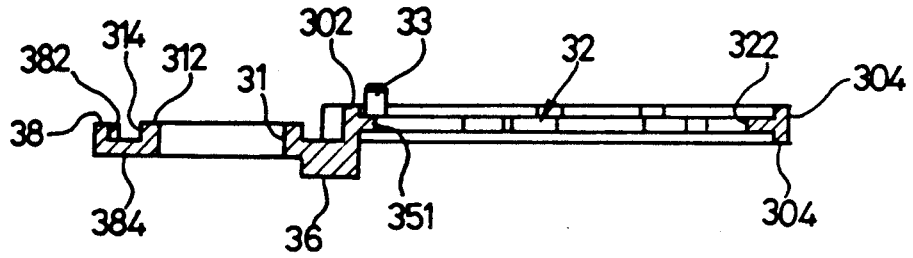
FIG. 14 is a sectional view taken along line 14—14 of FIG. 13.
Figure 15:
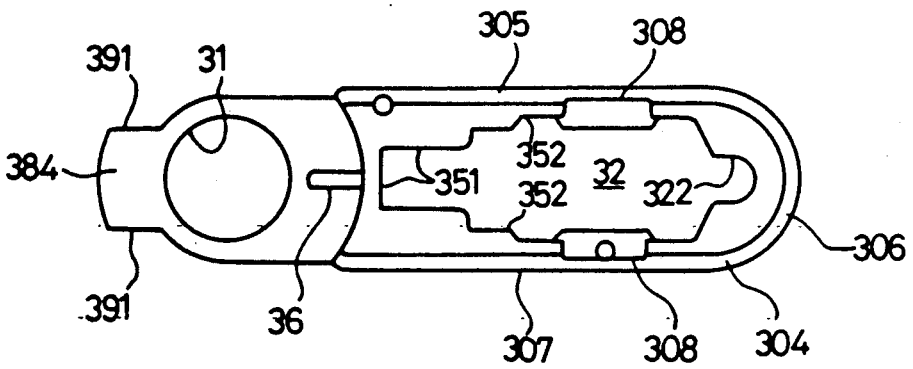
FIG. 15 is a front elevational view of the belt receiving member of FIG. 13.

Referring now to FIGS. 13 to 15, there is shown in detail one of the belt receiving members 30 installed between the main frame 10 and the sub frame 20.

Each of the belt receiving members 30 is molded from a material having a high lubricating performance such as, for example, POM or nylon, and has the form of a plate having formed therein an opening 31 through which the drive shaft extends and another opening 32 through which the support shaft extends. Such two plate members 30 are combined and coupled to each other such that such faces thereof as shown in FIG. 13 are disposed in an opposing relationship to each other. Each of the belt receiving members 30 has a flange portion 302 formed on an outer peripheral edge thereof around the opening 32, and a flange portion 303 is formed between the openings 31 and 32 such that it interconnects the opposite free ends of the flange portion 302. The two opposed belt receiving members 30 are thus assembled to each other with the flange portions 302 and 303 thereof held in abutting contact with each other. Accordingly, the two belt receiving members 30 have the same dimensions and the same configuration with each other, and a pair of fitting hubs 33 for assembly are implanted on an orthogonal line at upper and lower portions of the flange portion 302 of each of the belt receiving members 30 while a pair of fitting holes 34 for fitting with the fitting hubs 33 are formed similarly on an orthogonal line at upper and lower portions of the flange portion of each of the belt receiving members 30.

A ring portion 312 is formed on each of the belt receiving members 30 on the same side with the flange portion 302 around opening 31 through which the drive shaft extends. The ring portion 312 has a smaller axial dimension than flange portion 302 and supports, at an outer cylindrical peripheral face 314 thereof, an inner cylindrical peripheral face 54 (FIG. 4) of an annular flange 53 formed in a concentric relationship on an outer peripheral edge of the sprocket wheel 50.

A semi-arcuate flange portion 304 similar to the flange portion 303 is formed on an outer peripheral edge of an end portion of each of the belt receiving member 30 adjacent the opening portion 32 on the reverse side to the flange portion 303. Outer peripheral faces 305, 306 and 307 formed by the flange portions 302 and 304 form sliding faces for the endless belt 60. In particular, the outer peripheral faces 305 and 307 form sliding faces for guiding the endless belt 60 linearly while the outer peripheral face 306 forms a sliding face for guiding the endless belt 60 arcuately. A pair of sliding faces 308 (FIG. 15) are formed in an opposing relationship to each other at part of upper and lower portions of the flange portions 302 located on the outer side faces of the two belt receiving members 30 fastened to each other such that they may be slidably engaged with the end faces 129a of the ribs 129 of the main frame 10 and the end faces 25a of the projection 25 of the sub frame 20, respectively. A slide hub 36 is provided projectingly on the outer side face of each of the belt receiving members 30 on the line interconnecting the centers of the openings 31 and 32 and extends in a direction along the interconnecting line. The sliding hubs 36 are slidably engaged with the groove 114 of the main frame 10 and the groove 214 of the sub frame 20. The opening 32 has a configuration elongated along the line interconnecting the centers of the openings 31 and 32 and has rectangular end edge portions 351 adjacent the opening 31 for receiving therein the arm 16 formed on the main frame 10 and the arm 23 formed on the sub frame 20, and enlarged edge portions 352 for receiving therein the hub portions 127 and 128 and the lip portions 124 formed on the main frame 10. Further, an extension 322 of a reduced width is formed on the interconnecting line for receiving therein the hub portions 18 and 26 formed on the main frame 10 and the sub frame 20, respectively.

A projection 384 is formed at an end portion of each of the belt receiving members 30 adjacent the opening 31 on the outer side of the ring portion 312. The projection 384 has a smaller width than that of the end portion of the belt receiving members 30 and has an arcuate rib 38 formed at an end on the inner face thereof. The rib 38 has an inner face 382 formed as a cylindrical face concentric with an outer peripheral face of the ring portion 312 for guiding an outer peripheral surface of the belt 60 for sliding movement thereon. The rib 38 has a little smaller height than the height of the ring portion 312.

The belt driving sprocket wheel 50 is made of a plastic material and has driving teeth 52 formed on an outer periphery of a flange 53 thereof as shown in FIG. 4. The sprocket wheel 50 has a wall face 55 at a flat central portion whereof defined by an inner peripheral face 54 of the flange 53. The sprocket wheel 50 further has an angular hole 56 formed therein. The angular hole 56 is opened to the wall face 55 around the center axis of the sprocket wheel 50 and has such a square cross section as to allow the angular hole 56 to be engaged with the drive shaft.

The endless belt 60 has an endless inner peripheral face on which meshing teeth 62 are formed. The outer peripheral face of the endless belt 60 forms a paper feed face 64, and the feed pins 66 are implanted in a predetermined spaced relationship along the widthwise center line on the paper feed face 64 of the endless belt 60.

Figure 16:
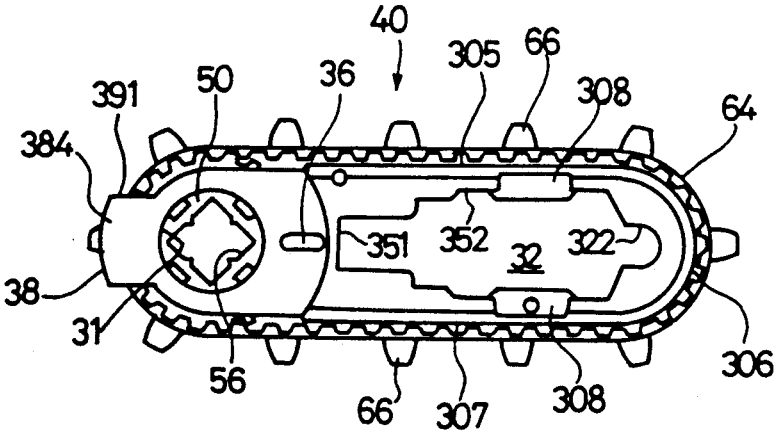
FIG. 16 is a front elevational view of a belt driving unit of the paper feed tractor of FIG. 1.
Figure 17:
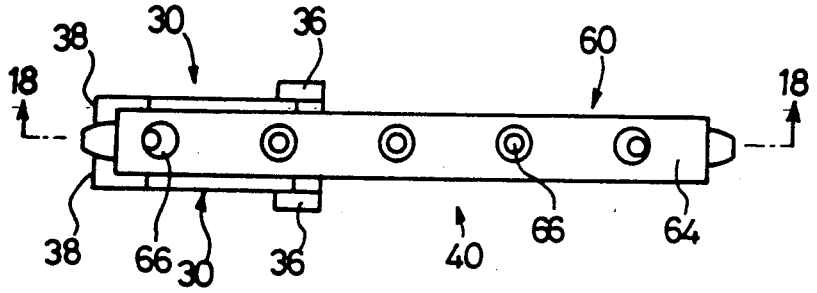
FIG. 17 is a bottom plan view of a belt driving unit of FIG. 16.
Figure 18:
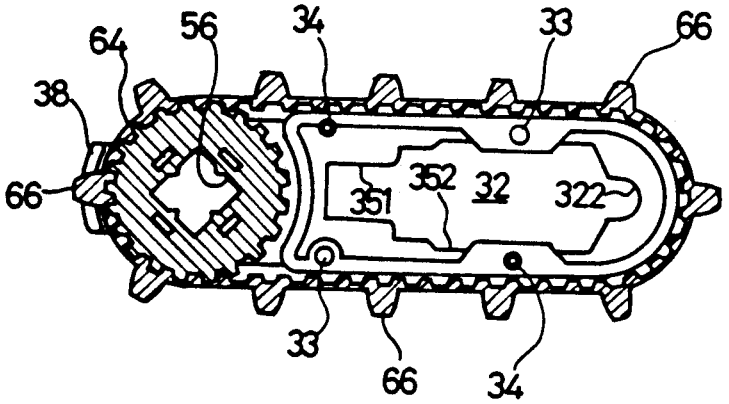
FIG. 18 is a sectional view taken along line 18—18 of FIG. 17.

FIGS. 16 to 18 show construction of the belt driving unit 40 which includes the two belt receiving members 30, the belt driving sprocket wheel 50 and the endless belt 60 in combination.

The flange 53 of the sprocket wheel 50 is fitted and supported at the inner peripheral face 54 thereof on the outer peripheral faces 314 of the ring portions 312 of the two opposed belt receiving members 30, and the endless belt 60 extends along the outer peripheries of the flange portion 302 and 304 of the belt receiving members 30 with the meshing teeth 62 thereof meshed with the driving teeth 52 of the sprocket wheel 50. The two belt receiving members 30 are fastened to each other in this condition, then the fitting hubs 33 thereof are individually fitted into the fitting holes 34 of the counterparts to integrate the two belt receiving members 30 with each other. Where the fitting hubs 33 and the fitting holes 34 are dimensioned so that they may be fitted in a tight fitting relationship with each other, the two belt receiving members 30 can be integrated with each other without requiring any other fastening means.

The belt driving sprocket wheel 50 is supported for rotation on the outer peripheral faces 314 of the ring portions 312 of the belt receiving members 30 while movement thereof in the axial direction is restricted at the opposite side walls 55 thereof between the annular end faces of the ring portions 312 of the belt receiving members 30. Since the paper feeding surface 64 on the outer periphery of the endless belt 60 meshing with the belt driving sprocket wheel 50 is fed in a circumferential direction of the sprocket wheel 50 in a restricted condition by the inner peripheral faces 382 of the arcuate ribs 38, the endless belt 60 is slidably moved along the outer peripheral faces 305, 306 and 307 of the flange portions 302 and 304 of the belt receiving members 30.

The belt driving unit 40 assembled in this manner is installed between the inner side face of the main frame 10 and the inner side face of the sub frame 20. The main frame 10 and the sub frame 20 are moved toward each other, then the arm 16 of the main frame 10 and the arm 23 of the sub frame 20 are extended through the rectangular end edge portions 352 of the openings 32 of the belt receiving members 30 and engaged with each other. Thus, the main frame 10 and the sub frame 20 are assembled in an integral relationship with the bent portion 162 of the arm 16 engaged with the bent portion 232 of the arm 23. Simultaneously, the projection 182 at the end of the hub 18 of the main frame 10 is fitted into the hole 262 of the hub 26 of the sub frame 20 so that the main frame 10 and the sub frame 20 are opposed accurately to each other to assure the integration of the main frame 10 and the sub frame 20.

In this condition, the slide hubs 36 extending from the opposite side faces of the belt driving unit 40 are supported for sliding movement in the groove 114 of the main the frame 10 and the groove 214 of the sub frame 20 while the sliding faces 308 are slidably abutted with the end faces 129a of the ribs 129 of the main frame 10 and the end faces 25a of the projections 25 of the sub frame 20. Further, the end of the arm 16 of the main frame 10 is contacted with the inner side face of the sub frame 20 and the hub 18 of the main frame 10 is contacted with the hub 26 of the sub frame 20 to maintain the main frame 10 and the sub frame 20 in a predetermined spaced relationship. The distance between the main frame 10 and the sub frame 20 is a little greater than the widthwise dimension of the belt driving unit 40. Accordingly, the belt driving unit 40 is supported between the main frame 10 and the sub frame 20 for sliding movement in the longitudinal direction of the main frame 10 and the sub frame 20 while maintaining small distances with respect to the main frame 10 and the sub frame 20. Further, the opposite widthwise outer peripheral edges 391 at end portions of the projections 384 of the belt receiving members 30 having the ribs 38 thereon are engaged with linear guide stepped portions 118 thereon at an end portion of the recess 112 of the main frame 10 and linear guide stepped portions 218 at an end portions of the recess 212 of the sub frame 20 while the reduced width extension 322 of the opening 32 is engaged with the hub 18 of the main frame 10 and the hub 26 of the sub frame 20. Consequently, the belt driving unit 40 is supported for sliding movement in the direction of the line interconnecting the openings 31 and 32 with respect to the main frame 10 and the sub frame 20.

The cover 70 has a pair of projections 71 and 72 formed on a side portion of a plate-formed body thereof as apparently seen from FIGS. 1 to 4. The projections 71 and 72 have the support shafts 712 and 722 formed at lower portions thereof, respectively. The shafts 712 and 722 are fitted in the grooves 132 and 142 of supporting portions 13 and 14 formed on the main frame 10, respectively, and the spring 150 having an end anchored to the spring receiver 15 of the main frame 10 is anchored at the end thereof to the spring receiver 724 formed on the projection 72 of the cover 70. The spring receiver 724 is located nearer to the main frame 10 than the locations of the support shafts 712 and 722, the force of the spring 150 acts to normally close the cover 70 in the closing direction toward the main frame 10.

A pair of ribs 752 and 754 are formed on a lower face of the cover 70 with a slit 74 defined therebetween and extend in the longitudinal direction of the cover 70, and another rib 756 is formed on the outer side in parallel to the ribs 752 and 754 on the lower face of the cover 70. A pair of lateral ribs 753 and 755 are provided at the opposite end portions of the ribs 752 and 754 such that they interconnect the ribs 752 and 754. The lateral ribs 753 and 755 are bridged between the ribs 752 and 754 such that gaps may be formed for the lower face of the cover.

The paper holder 80 is produced by shaping of a plastic plate material in the form of a flat elastic plate and has a slit 81 formed in a longitudinal direction therein. The paper holder 80 has a pair of paper holding portions 802 and 804 located on the opposite sides of the slit 81 and projected downwardly, and a pair of mounting portions 803 and 805 formed at the longitudinal opposite end portions thereof. The paper holder 80 is mounted on the lower face of the cover 70 by inserting the mounting portions 803 and 805 thereof into the gaps between the lower face of the cover 70 and the lateral ribs 753 and 755 making use of the elasticity of the paper holder 80 itself.

Figure 20:
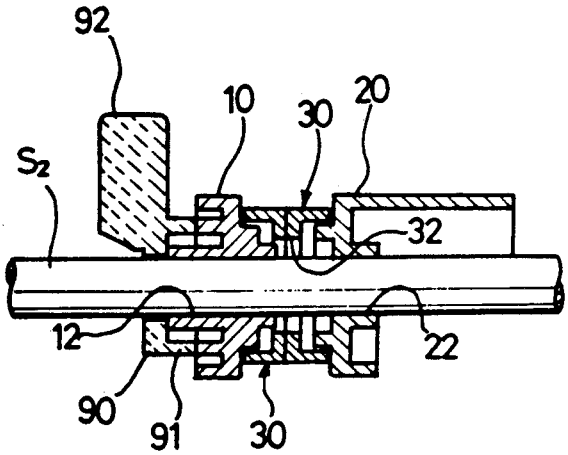
FIG. 20 is a sectional view off the paper feed tractor of FIG. 1 engaged with a support shaft.

The fixing device 90 has, as shown in FIGS. 4 and 20, a cylindrical portion 91, a lever handle 92 extending radially outwardly from the cylindrical portion 91, and a pair of legs 93 and 94 extending in parallel to each other in the direction of an axis of the cylindrical portion 91. The legs 93 and 94 are bent inwardly at end portions thereof to form arresting pawls 932 and 942. Thus, the legs 93 and 94 of the fixing device 40 are inserted into the arcuate through holes 125 and 126 of the main frame 10 along the smaller diameter outer peripheral portions 122*a* and 124*a* of the lip portions 122 and 124 and are advanced while deflecting the lip sections 122 and 124, respectively, then the lip portions 122 and 124 are returned to their original positions when the arresting pawls 932 and 942 are disengaged from the lip portions 122 and 124 so that the arresting pawls 932 and 942 of the legs 93 and 94 are engaged with inner end faces 124*b* of the lip portions 124. Consequently, the fixing device 90 is mounted for turning motion within a predetermined angular range on the main frame 10.

As apparent from the foregoing description, with the paper feed tractor according to the present invention, all of the parts can be assembled without requiring such a means as a fastening screw, a rivet or a bonding agent.

In the following, operation of the device of the present embodiment will be described.

Figure 19:
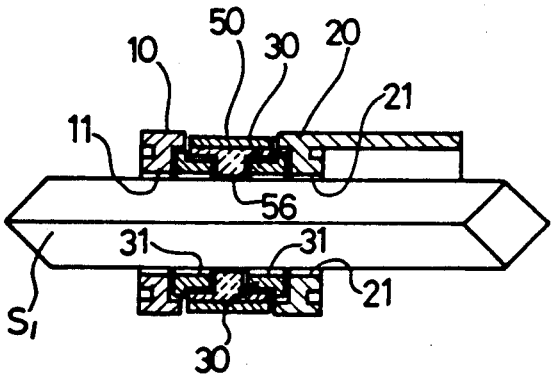
FIG. 19 is a sectional view of the paper feed tractor of FIG. 1 engaged with a drive shaft.

The paper feed tractor 1 in an assembled condition is installed in a printer such that the drive shaft $S_1$ is fitted in the opening 11 of the main frame 10 and the opening 21 of the sub frame 20 while the support shaft $S_2$ is fitted in the opening 12 of the main frame 10 and the opening 22 of the sub frame 20. Such fitting relationships of the drive shaft $S_1$ and the support shaft $S_2$ are illustrated in FIGS. 19 and 20, respectively.

In particular, the drive shaft $S_1$ having a square cross section extends through the opening 11 of the main frame 10, the opening 31 of the two belt receiving members 30 and the opening 21 of the sub frame 20 and is fitted in the angular hole 56 of the sprocket wheel 50. Since the openings 11, 31 and 21 have sufficiently great dimensions comparing with a maximum dimension of a cross section of the drive shaft $S_1$, the drive shaft $S_1$ is engaged only with the angular hole 56 of the sprocket wheel 50 to drive the sprocket wheel 50.

The support shaft $S_2$ has a circular cross section and is loosely fitted in the opening 12 of the main frame 10 and the opening 22 of the sub frame 20. The support shaft $S_2$ extends through the openings 32 of the two belt receiving members 30 so that it does not interfere with the belt receiving members 30 at all.

The fixing device 90 is turned by way of the lever handle 92, then the lip portions 122 disposed around the opening 11 on the outer side of the main frame 10 are deflected inwardly as the projections formed on the inner periphery of the cylindrical portion 91 of the fixing device 20 are moved from the smaller diameter outer cylindrical portions 122*a* to the greater diameter outer cylindrical portions. Meanwhile, the lip portions 124 disposed around the opening 11 on the inner side of the main frame 10 are deflected inwardly as the legs 93 and 94 are moved from the smaller diameter outer peripheral portions 124*a* to the greater diameter outer peripheral portions. Consequently, the inner diameter of the lip portions 122 and 124 is decreased to grasp the support shaft $S_2$ among the lip portions 122 and 124 to secure the paper feed tractor 1 to the support shaft $S_2$. A pair of such paper feed tractors disposed adjacent the opposite sides of paper supplied to the printer are thus adjusted in position in the widthwise direction of the printer and secured at the thus adjusted locations to the support shaft $S_2$. Thus, the paper is fed as the drive shaft $S_1$ is driven to rotate.

Figure 21:
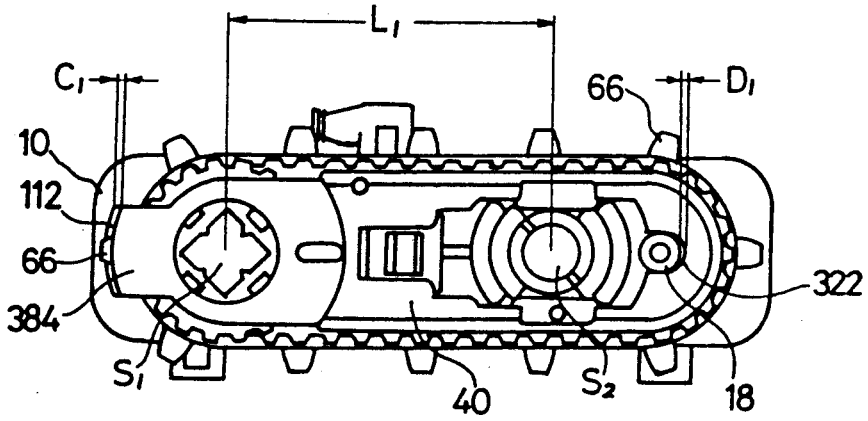
FIGS. 21 to 23 are schematic front elevational views illustrating three different operating conditions of the paper feed tractor of FIG. 1.
Figure 22:
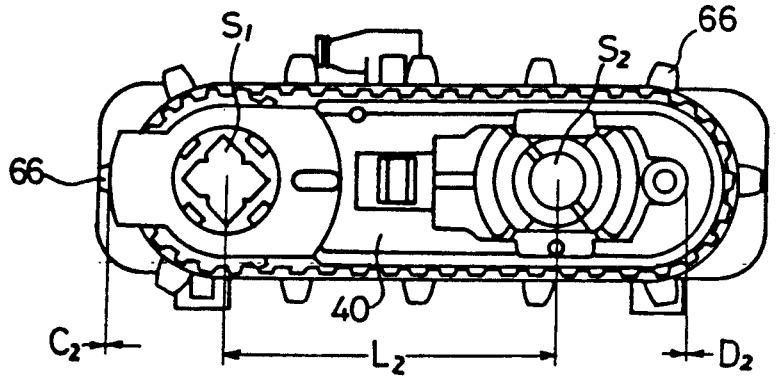
Figure 23:
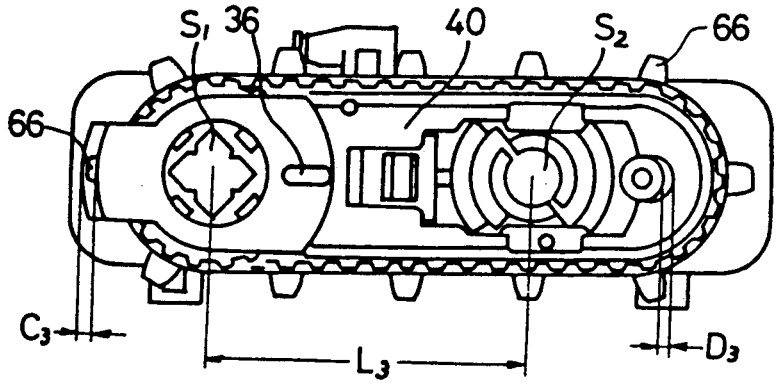
Figure 24:
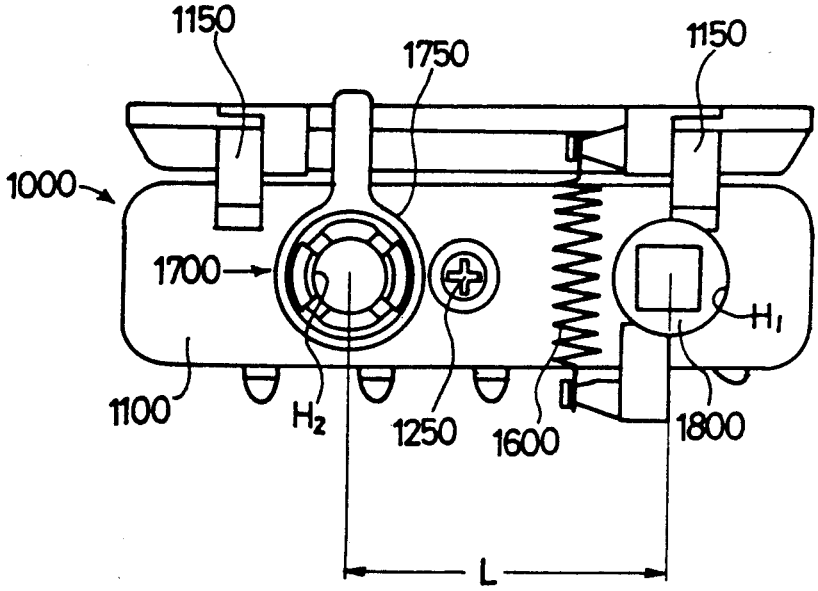
FIG. 24 is a front elevational view of a conventional paper feed tractor.
Figure 25:
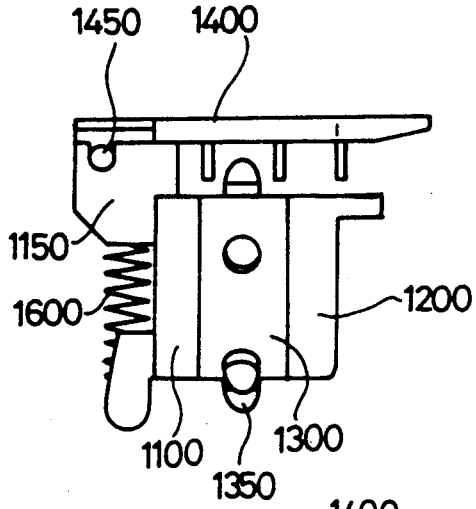
FIG. 25 is a right-hand side elevational view of the paper feed tractor of FIG. 24.
Figure 26:
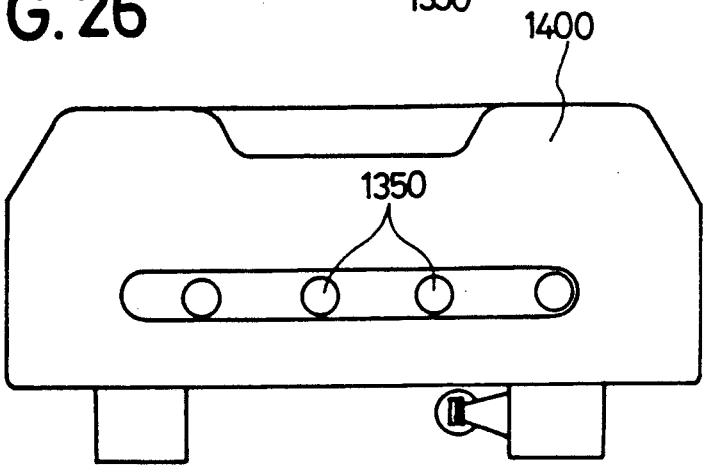
FIG. 26 is a top plan view of the paper feed tractor of FIG. 24.
Figure 27:
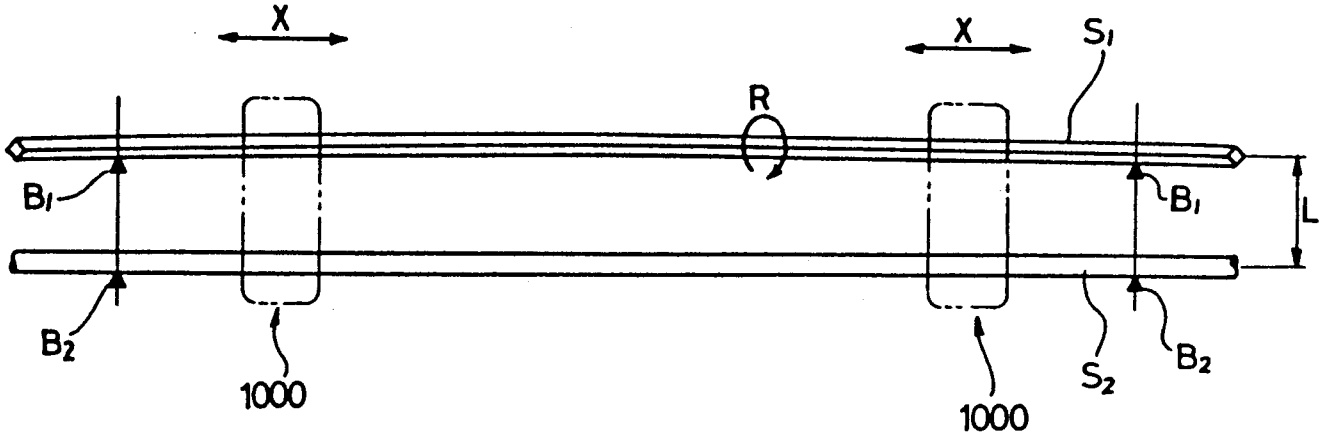
FIG. 27 is a schematic illustration showing a positional relationship of a drive shaft and paper feed tractors.
Figure 28:
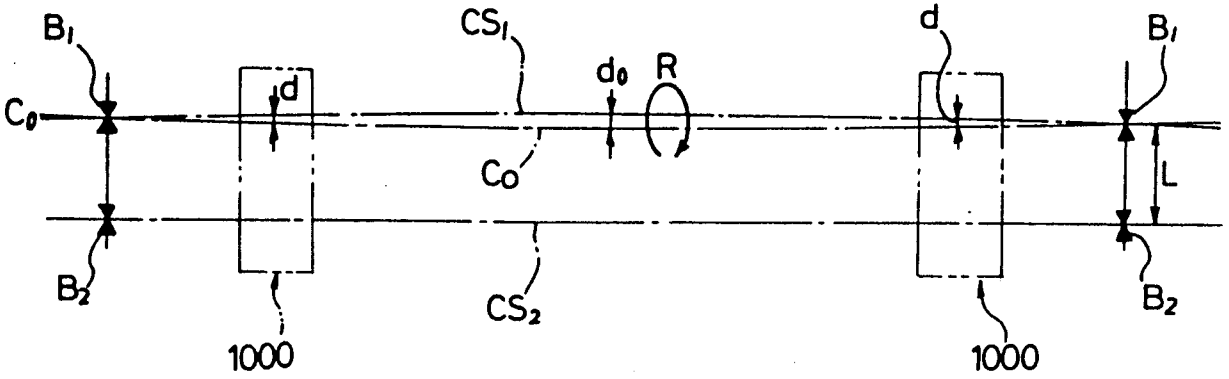
FIG. 28 is a schematic illustration showing eccentric rotation of the drive shaft of FIG. 27.

FIGS. 21 to 23 illustrate positional relationships of the belt driving unit 40 to the main frame 10 and the sub frame 20 when the interaxial distance between the drive shaft $S_1$ and the support shaft $S_2$ is varied by deflection of the drive shaft $S_1$. The sub frame 20 is not shown in these figures.

FIG. 21 shows such positional relationship when the interaxial distance $L_1$ between the drive shaft $S_1$ and the support shaft $S_2$ is in its normal condition. In the condition shown, a gap $C_1$ is formed between an end portion of the projection 384 at the end of the belt driving unit 40 adjacent the drive shaft $S_1$ and the end portion of the recess 112 of the main frame 10, and another gap $D_1$ substantially equal to the gap $C_1$ is formed between the hub 18 and the extremity of the reduced width extension 322.

To the contrary, if the drive shaft $S_1$ is rotated in an eccentric relationship in a direction spaced away from the support shaft $S_2$, then the entire belt driving unit 40 can be slidably moved as shown in FIG. 22 so that the distance $L_2$ between the drive shaft $S_1$ and the support shaft $S_2$ becomes greater than the distance $L_1$. Consequently, the gaps $C_2$ and $D_2$ are both decreased and may finally be reduced to zero.

On the contrary, if the drive shaft $S_1$ is moved in the direction to approach the support shaft $S_2$, the distance $L_3$ between the drive shaft $S_1$ and the support shaft $S_2$ becomes smaller than the distance $L_1$, and the gaps $C_3$ and $D_3$ are increased in dimension than those of the gaps $C_1$ and $D_1$.

Sliding movement of the entire belt driving unit is restricted as the slide hugs 36 are each abutted with an end portion of the groove in which it is engaged.

What is claimed is:

1. A paper feed tractor for supplying paper which has feed holes formed in an equidistantly spaced relationship in a row along a side edge thereof to a printer, comprising a main frame, a sub frame secured to said main frame and disposed in parallel relationship with said main frame for forming a space between said mainframe and said sub frame, and a belt driving unit including a belt receiving member disposed within said space formed between said main frame and sub frame and supported slidably relative to said main frame and said sub frame, a belt driving sprocket wheel, and a paper feeding endless belt, said main frame and said sub frame having first openings formed in a coaxial relationship at locations adjacent first end portions thereof, respectively, so as to allow a drive shaft of said printer to be extended therein and moved relative to said main frame and sub frame, said main frame and said sub frame having second openings formed in a coaxial relationship at locations displaced from said first openings toward second end portions thereof, respectively, so as to allow a support shaft of said printer to be slidably extended therein, said belt receiving member of said belt driving unit having a third opening formed at a location of a first end portion thereof opposing to said first openings of said main frame and said sub frame, respectively, so as to allow said drive shaft to be extended rotatably therein, said belt driving sprocket wheel having a shaft hole formed at a location around the center axis of rotation thereof so as to allow said drive shaft to be fitted therein for sliding movement in its axial direction but for engagement in its rotational direction, said belt driving sprocket wheel rotatably supported on said belt receiving member with said shaft hole thereof exposed to said third opening of said belt receiving member, said belt receiving member having a fourth opening at a location of a second end portion thereof opposing to said second opening of said main frame and said sub frame so as to allow said support shaft to be extended therein and moved relative to said belt receiving member, and said paper feeding endless belt being engaged in meshing engagement with an outer peripheral portion of said belt driving sprocket wheel at said first end portion of said belt receiving member and extended in sliding movement along outer peripheral faces of said second end portion and portions located between said first and second end portions, one of said main frame and sub frame having at least a linear guide stepped portion on a surface opposing to said belt receiving member of said belt driving unit along a line interconnecting said first and second openings and said belt receiving member having a guide member to be engaged with said linear guide stepped portion for sliding movement therewith, thereby said belt driving unit being supported for sliding movement along the line interconnecting said first and second openings relative to said main frame and said sub frame.

2. A paper feed tractor according to claim 1, wherein a semi-cylindrical belt guiding face having substantially the same diameter as an outer periphery of said belt driving sprocket wheel is formed on said outer peripheral face of said second end portion thereof of said belt receiving member and a pair of linear belt guiding faces extending in a direction parallel with said line interconnecting said first and second openings are formed on outer peripheral faces of said belt receiving member along side edges thereof in a continguous relationship to the opposite ends of said semi-cylindrical belt guiding face at locations adjacent said third openings.

3. A paper feed tractor according to claim 2, wherein said belt receiving member of said belt driving unit is composed of a pair of members having a same configuration and engaged in an opposing relationship with each other, and a ring portion is formed on each of said members of said belt receiving member along a peripheral edge of said third opening and projected to the inner side thereof, and said sprocket wheel is supported on outer cylindrical peripheral faces of said ring portions of said members of said belt receiving member by an inner cylindrical peripheral face of an annular rib formed on an outer peripheral edge thereof.

4. A paper feed tractor according to claim 3, wherein an arcuate rib is formed on each of said members of said belt receiving member of said belt driving unit in a concentric relationship at a location outside said ring portion on which said belt driving sprocket wheel is supported and a cylindrical face is formed on an inner peripheral face of said arcuate rib in a concentric relationship to the outer peripheral faces of said ring portions having cylindrical face, and said endless belt is held between said belt driving sprocket wheel and the inner cylindrical face of said arcuate ribs formed on said members of said belt receiving member.

* * * * *